US005373652A

United States Patent [19]

Olsson

[11] Patent Number: 5,373,652

[45] Date of Patent: Dec. 20, 1994

[54] SWEEPING APPLIANCE FOR EXCAVATORS

[75] Inventor: Gunnar Olsson, Kramsta, S-820 40 Järvsö , Sweden

[73] Assignee: Gunner Olsson, Jarvso, Sweden

[21] Appl. No.: 81,363

[22] PCT Filed: Jan. 2, 1992

[86] PCT No.: PCT/SE92/00001

§ 371 Date: Jun. 30, 1993

§ 102(e) Date: Jun. 30, 1993

[87] PCT Pub. No.: WO92/12298

PCT Pub. Date: Jul. 23, 1992

[30] Foreign Application Priority Data

Jan. 10, 1991 [SE] Sweden ..... 9100069-5

[51] Int. Cl.[5] ..... E02F 3/76

[52] U.S. Cl. ..... 37/403; 37/410

[58] Field of Search ..... 37/403, 468, 408, 410, 37/903, 443, 104, 105, 379, 347

[56] References Cited

U.S. PATENT DOCUMENTS 3,779,408 12/1973 Ivie ..... 37/403 X
3,922,745 12/1975 Lehman .
4,100,688 7/1978 Grist ..... 37/410 X
4,974,349 12/1990 Timmons ..... 37/403 X

FOREIGN PATENT DOCUMENTS 454899 6/1988 Sweden .
00488 10/1987 WIPO .

*Primary Examiner*—Dennis L. Taylor
*Attorney, Agent, or Firm*—McFadden, Fincham

[57] ABSTRACT

The invention relates to a sweeping appliance for excavators of the type comprising a stick (1) and a bucket (4) carried by said stick via a transverse pivot pin (5), said appliance including a rotary brush (13) arranged at a free end of a holder (12) whose opposite end is articulated to said stick or said pivot pin to allow pivoting of the holder between a position remote from said stick, in which the brush can actively perform a sweeping operation, and an inactive position close to said stick. The holder (12) is divided into at least two parts (16,17), of which an outer, brush-carrying part (17) is rotatable relative to an inner part (16), more precisely by means of a rotary unit (25) operating between said two parts, thereby permitting the brush to turn about an axis extending at right angles to the axis of rotation of said brush.

10 Claims, 2 Drawing Sheets

SWEEPING APPLIANCE FOR EXCAVATORS

BACKGROUND OF THE INVENTION

The present invention relates to a sweeping appliance for excavators of the type comprising a pivotable arm or stick and a bucket carried by said stick via a transverse pivot pin, said appliance including a rotary brush arranged at a free end of a holder whose opposite end is articulated to said stick or said pivot pin to allow pivoting of the holder between a position remote from said stick, in which the brush can actively perform a sweeping operation, and an inactive position close to said stick.

DESCRIPTION OF THE PRIOR ART

A sweeping appliance of the type described above is disclosed in SE 8604502-8 (Publ. No. 454,899). Immediately after an excavating operation by means of the bucket, this sweeping appliance can in a smooth, quick and labor-saving manner be used for final uncovering of buried lines, such as electric lines, gas soil pipes, water conduits and the like, in a sweeping operation which is gentle on the lines. An essential advantage of the appliance is that it can cooperate alternately with the bucket in such a manner that on the one hand the appliance can be released from its inactive position and moved to an active position immediately after a completed excavating operation and, on the other hand, it can easily and rapidly be moved back to its inactive position after the sweeping operation is completed, thereby again permitting an excavating operation. In other words, the bucket need not be dismounted from the associated standard mounting or appliance mounting and replaced by a separate sweeping appliance, nor is it necessary to operate with two separate vehicles, one fitted with a sweeping appliance and the other with a bucket. Since both functions of the only vehicle, i.e. excavating by means of the bucket and sweeping by means of the sweeping appliance, can be alternated without any time-consuming shifting operations, the total operation of uncovering the buried lines can be carried out extremely rapidly and efficiently and at minimum cost.

A serious drawback of the sweeping appliance according to SE 8604502-8 is however that the brush—apart from being rotatable per se—is immovably mounted on the associated holder. The earth which is to be brushed away from the lines in a trench that has been dug can thus be brushed away merely straight backwards or straight forwards from the brush in a direction perpendicular to the axis of rotation thereof. In practice, this direction coincides with the vertical plane in which the stick is pivotable. This limitation of the possibilities of moving the brush renders a number of operations difficult or even impossible, for example brushing of intersecting lines, brushing of complicated compositions of lines, brushing of rails etc.

SUMMARY OF THE INVENTION

The main object of the present invention is to provide a sweeping appliance of the type described by way of introduction, in which the brush itself can be shifted between different positions relative to the plane in which the stick and the holder are movable. A further object of the invention is to provide an appliance in which this possibility of shifting is accomplished by simple and inexpensive means. One more object is to provide a sweeping appliance in which at least the part of the holder which is closest to the brush requires a minimal space, thereby making the brush easily movable even in narrow spaces, such as narrow trenches or ditches. A still further object of the invention is to provide an appliance in which brushes of different dimensions can readily be used on one and the same holder.

BRIEF DESCRIPTION OF THE INVENTIVE CONCEPT

To achieve at least the main object of the invention, the sweeping appliance according to the invention is characterised in that the holder is divided into at least two parts, of which an outer, brush-carrying part is rotatable relative to an inner part, more precisely by means of a rotary unit operating between said two parts, thereby permitting the brush to turn about an axis extending at an angle, e.g. at right angles to the axis of rotation of the brush.

Since the holder—which in practice must be of comparatively great length to facilitate moving away of the brush to an inactive position which is safely remote from the working range of the bucket—is divided into two parts, of which the outer, brush-carrying part is rotatable relative to the inner part, the brush can be easily and smoothly turned to a plurality of infinitely variably selectable rotational positions relative to the vertical plane in which the stick is movable. In this manner, the brush can brush e.g. such elongate objects as lines and rails not only on the top surfaces thereof, but also on the lateral surfaces. Owing to the mutual rotating capacity of the holder parts, the brush may also be used to direct the brushed-away material transversely of the trench or path along which the excavator or vehicle moves.

FURTHER DESCRIPTION OF THE PRIOR ART

SE 8803091-1 discloses a sweeping appliance, the brush of which is per se turnable relative to the stick of an Excavator. In this prior-art appliance, the brush holder is however connected to the standard mounting of the stick via a particular frame. This means that the standard mounting of the stick cannot carry a bucket at the same time, which is a considerable drawback in the practical work with the uncovering of buried lines. In such work, it is desirable to uncover short distances (e.g. 5–20 m) which are dug and swept separately, rather than first digging the trench along the entire line and subsequently return and sweep the entire line from the beginning. In practice, the sweeping appliance disclosed in SE 8803091-1 cannot successfully be used to uncover lines a short distance at a time since the times required for switching between brush and bucket would make the uncovering operation extremely time-consuming and costly.

BRIEF DESCRIPTION OF THE ACCOMPANYING DRAWINGS

In the drawings

FIG. 1 is a simplified side view of the sweeping appliance according to the invention, mounted on a bucket-carrying stick or arm of an excavator, FIG. 2 is a perspective view of the appliance shown in FIG. 1 with the associated brush in a first position, FIG. 3 is a similar perspective view of the brush in a different position, and FIG. 4 is a schematic end view illustrating various positions of the brush of the appliance.

DETAILED DESCRIPTION OF A PREFERRED EMBODIMENT OF THE INVENTION

Figure 1:
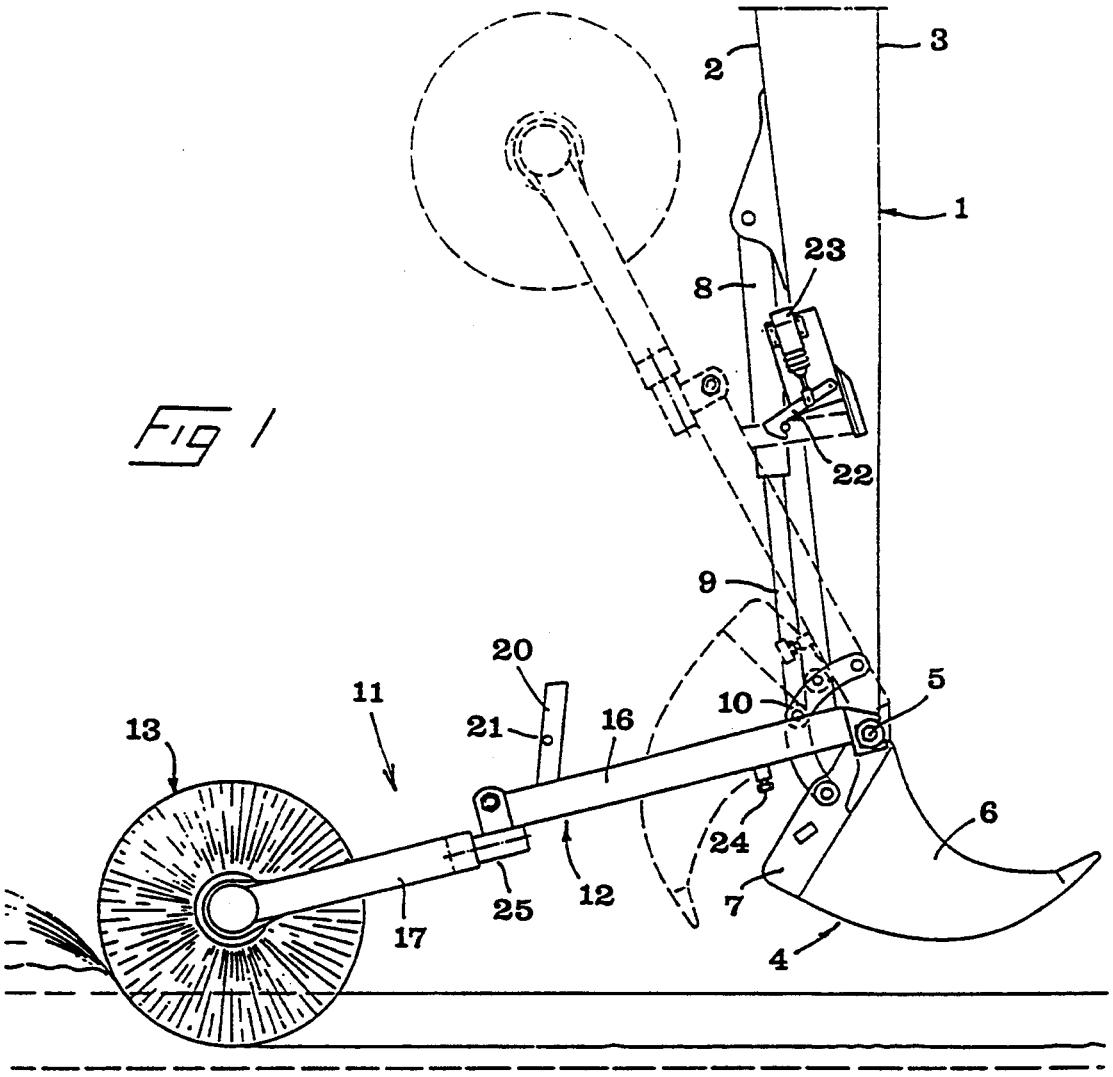

FIG. 1 illustrates an arm or stick, generally designated 1, of an excavator or some other wheel-mounted vehicle (not shown). The stick is pivotable and vertically movable by means of a suitable mechanism (not shown). The upper side of the stick is designated 2, while the lower side is designated 3. At its tip or free end, the stick 1 carries a bucket which is designated 4 in its entirety. More precisely, the bucket 4 is articulated to the stick via a transverse pivot pin 5. In the embodiment illustrated, the bucket 4 is shown to comprise an actual bucket member 6 which in conventional manner is detachably mounted on a standard-type appliance mounting 7 which in turn is connected to the stick via the pivot pin 5. On the upper side 2 of the stick 1 there is arranged a hydraulic cylinder 8 whose piston rod 9 is connected at its free end to the standard mounting 7 via a per se known link mechanism 10 which permits pivoting of the appliance mounting or the bucket within a great range of motion.

The sweeping appliance according to the invention, which is designated 11 in its entirety, comprises a brush 13 and a holder generally designated 12. The brush 13 is of the type with individual bristles extending radially outwards from a central hub, the ends of the individual bristles Jointly forming a substantially cylindrical surface 14. In addition, the brush is defined by two suitably flat end walls 15, 15' (see also FIGS. 2 and 3). The dimensions of the brush can vary within wide limits. Thus, the brush may have a diameter in the range 0.5–1.0 m, while the width may be anything between 0.05 and 1.0 m. In the prototype illustrated in the drawings, the diameter of the brush is 60 cm and the width 20 cm.

Figure 2:
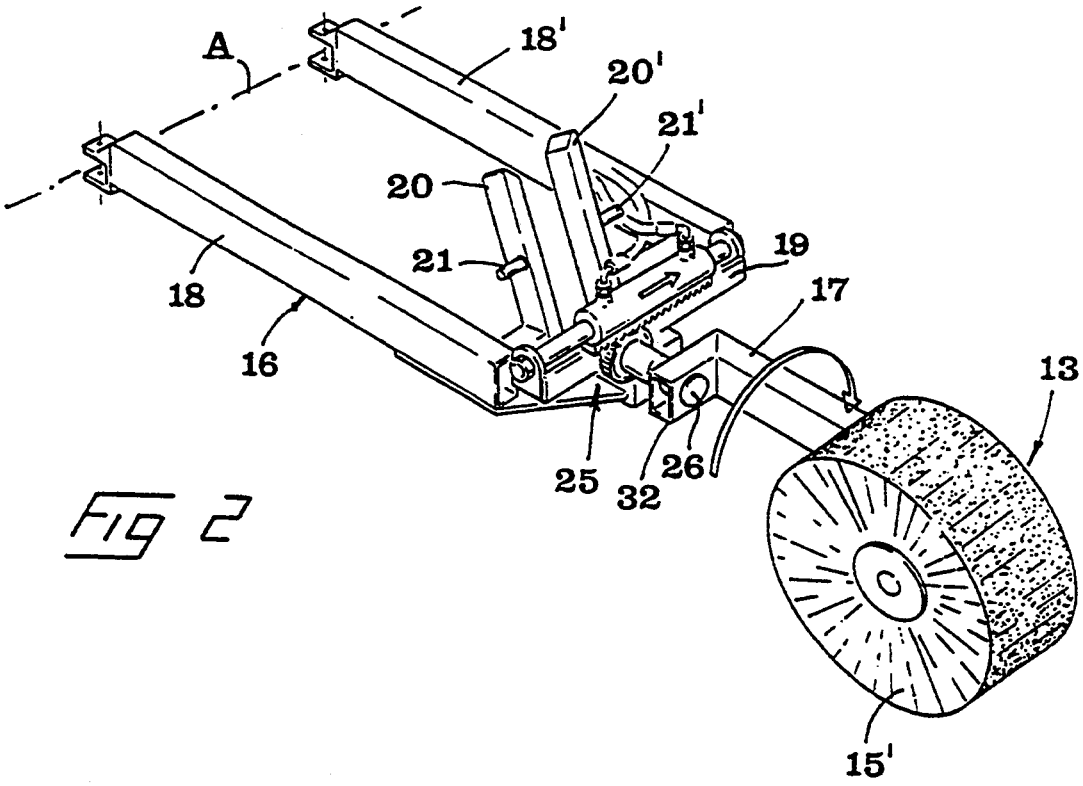
Figure 3:
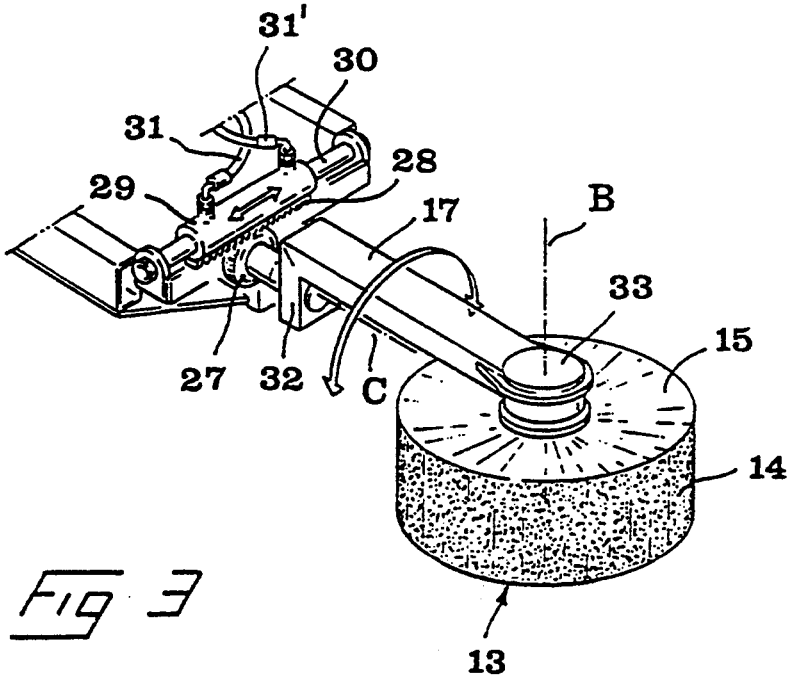

The holder 12 carrying the brush 13 is, as is best seen in FIGS. 2 and 3, divided into two parts 16, 17, of which the outer, brush-carrying part 17 is rotatable relative to the inner part 16. In the preferred embodiment as described, the inner part 16 is a substantially U-shaped yoke which comprises two legs 18, 18' which are rigidly interconnected via a cross member 19. The free ends of the legs 18, 18' which are facing away from the cross member 19 are in some suitable manner (not shown) articulated to the stick or, in this case, to extensions of the pivot pin 5 connecting the bucket to the stick. The U-yoke 16 thus is pivotable about an axis A coinciding with the axis 5 between the bucket and the stick. On the cross member 19 there are mounted two brackets 20, 20', each having a stop element in the form of a finger 21, 21' adapted to cooperate with a locking mechanism 22 on each side of the stick 1. As shown in FIG. 1, the locking mechanism 22 can advantageously be a pawl which is pivotable between engaging and disengaging positions by means of a magnetisable piston-and-cylinder mechanism 23. On the side of the legs 18, 18' which is opposed to the brackets 20, 20', there are arranged adjusting screws 24 for permitting adjustment of the engaging positions of the stop elements relative to the pawls 22. By means of these adjusting screws 24, the engaging position of the stop elements thus can be exactly adjusted for example after changing the bucket or the appliance mounting.

Between the U-yoke or inner part 16 and the outer part 17 of the holder 12 there is arranged a rotary unit which is designated 25 in its entirety. In the embodiment illustrated, this unit comprises a gear wheel 27 which is nonrotatably connected with a rotary shaft 26 and meshes with a straight gear rack 28 of an element 29 that is movable back and forth transversely of the shaft 26. This movable element is a cylinder or cylinder-shaped sleeve which is movably arranged on the outside of a piston rod 30 which is fixedly mounted on the cross member 19 and with which a piston (not shown) is fixedly connected which divides the cylinder 29 into two chambers, each communicating with a hydraulic fluid line 31, 31', viz. a supply and a return line for supplying and evacuating hydraulic fluid to and, respectively, from the two chambers. As a result, a double-acting piston-and-cylinder mechanism thus is formed, the cylinder of which is movable back and forth relative to the fixed piston rod 30, while carrying along the straight gear rack 28 whose rectilinear movement is transformed via the gear wheel 27 to a rotary motion of the shaft 26.

The outer part 17 of the holder is a single arm whose one end is ridigly connected with an elbow 32 which in turn is nonrotatably connected with the shaft 26. In actual practice, the arm 17 as well as the elbow 32 can be made of box sections. The free end of the arm 17 facing away from the elbow 32 carries a hydraulic motor 33 for rotating the brush 13. The hydraulic motor 33 can advantageously be permanently mounted on the outer arm, whereas the brush itself with its central hub is detachably mounted on the hydraulic motor so as to be replaceable, either by a new brush of the same dimensions or by a brush having other dimensions. For different operations, use can thus be made of different brushes having varying widths and/or diameters. The two hydraulic lines required for the motor 33 can advantageously be laid in the box sections forming the arm 17 and the elbow 32, respectively, although for lack of space these lines are not shown in drawings. The axis of rotation B of the hydraulic motor 33 and, thus, also of the brush 13 extends suitably at right angles to the arm 17 and, analogously, also the elbow 32 extends at right angles to the arm 17. This results in the arm 17 being located laterally offset relative to the axis C around which the arm is rotatable. Although it is per se possible to use different brushes on the hydraulic motor 33, it is in practice convenient to use a brush whose width is about twice the distance between the axis C and the arm 17. As a result, the axial centre of the brush 13 is positioned approximately along the axis C.

In practice, the holder 12 should in its entirety have a fairly considerable length to permit the brush 13 to be safely remote from the working range of the bucket 4 in its inactive state. Thus, this length (measured from the pivot axis 5 to the axis of rotation B) should amount to at least 50% of the length of said stick 1 and preferably more than 50%.

The sweeping appliance according to the invention operates as follows.

Figure 4:
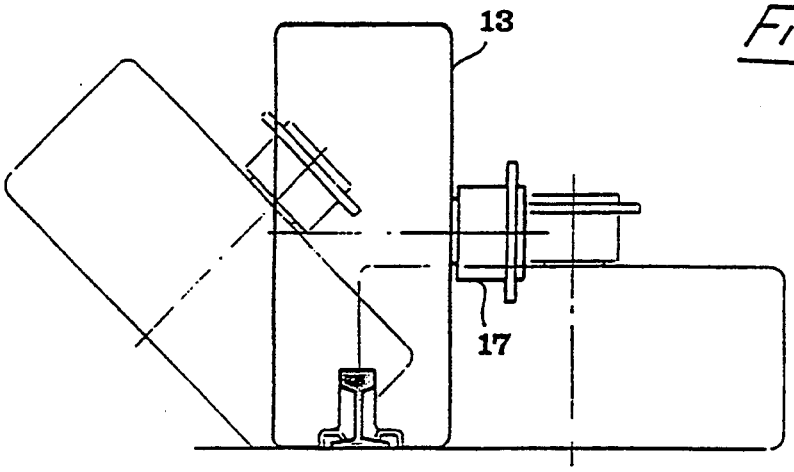

From its inactive position indicated by dashed lines in FIG. 1, the brush holder 11 can be lowered to the active position indicated by full lines, in which sweeping by means of the brush 13 can be carried out. This lowering is suitably effected by means of the bucket 4 against which the yoke legs 18, 18' can be caused to rest after being released by the locking mechanisms 22, whereupon the bucket is pivoted back, while the brush smoothly abuts against the base. Lowered to the active position, the brush rests against the base by its own weight and that of the holder 12. In the active position, the brush 13 can be infinitely variably turned to different rotational positions by means of the rotary unit 25. In practice, the rotary unit shown permits turning of the brush through about 270°. As illustrated in FIG. 4, the brush can be set in, for example, a completely vertical position (indicated by full lines), in a horizontal position or in various inclined positions between these vertical and horizontal positions. If the stick is lifted so that the holder 12 is positioned substantially vertically, the brush may be further turned to working directions transversely of the travelling direction of the vehicle, e.g. at right angles thereto, or in inclined positions. All these settings of the brush can be effected in a quick and infinitely variable manner by simple displacement of the cylinder 29 along the piston rod 30. After the sweeping or brushing has been accomplished, the appliance can be raised to its inactive position by pivoting the bucket in a direction opposed to the initial pivoting movement, the yoke legs 18, 18' being carried along such that the stop elements 21, 21' are finally caught and locked by the locking mechanisms 22. Subsequently, the bucket 4 is free to operate without being interfered with by the sweeping appliance.

Possible Modifications of the Invention

The invention is of course not restricted to the embodiment described above and illustrated in the drawings. Thus, it is per se feasible to use, instead of a U-shaped yoke, a single arm also as the inner part of the brush holder. Vice versa it is also feasible to use a U-yoke as the outer part, the two legs of the yoke embracing the brush 13. Moreover, it is possible to use rotary units other than the one exemplified in the drawings, for example in the form of conventional rotators. Although it is preferred because of the expense to operate the brush holder 12 by means of the bucket itself, it is per se also possible to arrange on the stick a hydraulic cylinder by means of which the holder can be distinctly pivoted between different pivoting positions, without cooperating with the bucket (in this case, specific locking mechanisms can be excluded).

I claim:

1. A sweeping appliance for excavators of the type comprising a pivotal arm 1, a bucket 4, and a transverse pivot pin mounting said bucket on said arm, said appliance including a rotary brush 13 mounted at a free end of a holder 12, the holder pivotally mounted at an opposite end on said arm, said holder pivotal between a position remote from said arm for said brush to perform a sweeping operation, and an inactive position close to said arm, characterized by said holder 12 comprising at least two parts, an inner part 16 and an outer part 17, said outer part 17 comprising a brush carrying part rotatable relative to said inner part 16 and including a brush rotatable about an axis B, rotatable means 25 between said outer part and said inner part for rotating said outer part 17 and said brush 13 relative to said inner part about an axis C extending at an angle to the axis of rotation B of said brush 13 and motor means on said outer part 17 for driving said brush 13, said motor means comprising a hydraulic motor 35 mounted on said outer part 17, said brush extending substantially perpendicular to the longitudinal extent of said outer part, said axis of rotation B of said brush adjacent to a free end of said outer part.

2. Sweeping appliance as claimed in claim 1, characterized in that said opposite end of the outer part (17) comprises an elbow (32) connecting said outer part to a rotary shaft (26) of said rotatable means (25), whereby the longitudinal axis of said outer part (17) is located laterally offset relative to said rotary shaft (26).

3. Sweeping appliance as claimed in claim 2, characterized in that the distance between said outer part (17) and said rotary shaft (26) is substantially half the axial width of the brush (13).

4. Sweeping appliance as claimed in claim 1, characterized in that the inner part of said holder (12) is a substantially U-shaped yoke (16) comprising two legs (18,18') whose free ends are articulated to said arm on opposite sides of the arm.

5. Sweeping appliance as claimed in claim 1, characterized in that the rotatable means (25) comprises a gear wheel (27) connected with said rotary shaft (26) and meshing with a straight gear rack (28) formed on an element (29) which is movable back and forth transversely of said rotary shaft.

6. Sweeping appliance as claimed in claim 5, characterized in that said element (29) is a cylinder which is movably mounted on the outside of a stationary piston rod (30) mounted on the inner part (16) of said holder and including a piston which divides the cylinder into two chambers, each communicating with a hydraulic fluid line (31,31'), comprising a supply line and a return line for supplying and evacuating hydraulic fluid to and, respectively, from the two chambers, while forming a double-acting piston-and-cylinder mechanism whose cylinder is movable back and forth relative to said fixed piston rod.

7. Sweeping appliance as claimed in claim 1, characterized in that at least one stop element (21) is connected with the inner part (16) of said holder and adapted to cooperate with a releasable locking mechanism (22) which is mounted on said arm and by means of which said holder can be retained in its inactive position close to said arm, the holder being pivotable to and from this position by means of the bucket (14).

8. Sweeping appliance as claimed in claim 7, characterized in that at least one adjusting screw (24) is connected with the inner part (16) of said holder to permit adjustment of the engaging position of said stop element (21) relative to said locking mechanism (22), after changing said bucket.

9. Sweeping appliance as claimed in claim 1, said holder 12 including means mounting said holder at said opposite end on said pivot pin 5, to pivotally mount said holder 12 on said arm 1.

10. Sweeping appliance as claimed in claim 1, said outer part of said holder comprising a single arm.

* * * * *

UNITED STATES PATENT AND TRADEMARK OFFICE

CERTIFICATE OF CORRECTION

PATENT NO. : 5,373,652

DATED : December 20, 1994

INVENTOR(S) : Gunnar Olsson

It is certified that error appears in the above-indentified patent and that said Letters Patent is hereby corrected as shown below:

Title page, item [73], Assignee: should be deleted--.

Signed and Sealed this

Eighteenth Day of April, 1995

Bruce Lehman

*Attest:*

BRUCE LEHMAN

*Commissioner of Patents and Trademarks*

*Attesting Officer*